US011268365B2

(12) United States Patent
Shetty et al.

(10) Patent No.: US 11,268,365 B2
(45) Date of Patent: Mar. 8, 2022

(54) ESTIMATING ACTIVE FRACTURES DURING HYDRAULIC FRACTURING OPERATIONS

(71) Applicant: Halliburton Energy Services, Inc., Houston, TX (US)

(72) Inventors: Dinesh Ananda Shetty, Sugarland, TX (US); Vladimir Nikolayevich Martysevich, Spring, TX (US); Tirumani N. Swaminathan, Houston, TX (US); Jianfu Ma, Pearland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 258 days.

(21) Appl. No.: 16/415,341

(22) Filed: May 17, 2019

(65) Prior Publication Data

US 2020/0362680 A1 Nov. 19, 2020

(51) Int. Cl.
*E21B 43/26* (2006.01)
*E21B 47/00* (2012.01)

(52) U.S. Cl.
CPC ..... *E21B 43/26* (2013.01); *E21B 47/00* (2013.01)

(58) Field of Classification Search
CPC ..... E21B 43/26; E21B 47/00
See application file for complete search history.

(56) References Cited

U.S. PATENT DOCUMENTS

| | | | |
|---|---|---|---|
| 5,105,659 | A | 4/1992 | Anyoub |
| 6,705,398 | B2 | 3/2004 | Weng |
| 8,838,427 | B2 | 9/2014 | Segal et al. |
| 9,350,627 | B2 | 5/2016 | Cremonesi et al. |

(Continued)

FOREIGN PATENT DOCUMENTS

| | | | |
|---|---|---|---|
| RU | 2270335 | C2 | 2/2006 |
| WO | 2018132106 | A1 | 7/2018 |

OTHER PUBLICATIONS

Hou, et al.; "A new method for evaluating the injection effect of chemical flooding"; Petroleum Science, vol. 13, Issue 3; DOI 10.1007/s12182-016-0091-8; CrossMark; Springer; Springerlink.com; Apr. 8, 2016; 11 pgs.

(Continued)

*Primary Examiner* — Robert E Fuller
(74) *Attorney, Agent, or Firm* — John W. Wustenberg; Parker Justiss, P.C.

(57) ABSTRACT

The disclosure is directed to a method and system that estimates the number of active fractures for a given hydraulic fracturing fluid pressure. The hydraulic fracturing pressure can be correlated to a corresponding hydraulic fracturing fluid absorption rate of downhole fractures. Using the pressure and rate correlation, an active fracture ratio can be determined and then utilized to estimate the number of active fractures at a given hydraulic fracturing fluid pressure. In other aspects, a target fluid pressure is represented by a curve or other shape corresponding to a fluid friction model so that the fluid pressure correlation to the fluid absorption rate can be utilized to compute the active fracture ratio. The (Continued)

FIG. 4 disclosed system is operable to control a well site pump system to adjust the fluid pressure and fluid composition, to monitor the downhole fluid, to collect the fluid values, and to compute an estimated active fracture ratio.

22 Claims, 6 Drawing Sheets

(56) References Cited

U.S. PATENT DOCUMENTS

| | | | |
|---|---|---|---|
| 9,416,644 | B2 | 8/2016 | McEwen-King et al. |
| 9,465,123 | B2 | 10/2016 | Lin |
| 2014/0058686 | A1 | 2/2014 | Anderson et al. |
| 2016/0251948 | A1 | 9/2016 | Weng et al. |
| 2017/0226838 | A1 | 8/2017 | Ciezobka et al. |
| 2017/0254186 | A1 | 9/2017 | Aidagulov et al. |
| 2019/0330975 | A1* | 10/2019 | Martysevich ..... E21B 47/10 |

OTHER PUBLICATIONS

Brayden; "A Class of Methods for Solving Nonlinear Simultaneous Equations"; Mathematics of Computation; American Mathematical Society; 19(92); Apr. 20, 1965; pp. 577-593.

Ryaben'kii, et al.; "Theoretical Introduction to Numerical Analysis"; CRC Press; 2006; 313 pgs.

* cited by examiner

ESTIMATING ACTIVE FRACTURES DURING HYDRAULIC FRACTURING OPERATIONS

TECHNICAL FIELD

This application is directed, in general, to monitoring hydraulic fracturing operations and, more specifically, to monitoring active fractures during hydraulic fracturing operations in a borehole.

BACKGROUND

In operating and managing a hydraulic fracturing (HF) well system, the HF well system operation team may need to gain more information regarding the stimulation fluid path. As HF fluid is pumped into a borehole, fractures along the borehole length may absorb or take in the HF fluid at various rates. Understanding the number of fractures that are actively taking in HF fluid at a selected HF pump pressure can be beneficial to the well system operation team. In unconventional reservoirs, determining the number of fractures can be of increased difficulty. In addition, the actual functional form of the pressure losses may not be known.

SUMMARY

In one aspect, a method for estimating a number of active fractures in a borehole of a well system during a hydraulic fracturing (HF) operation is disclosed. In one embodiment, the method includes: (1) obtaining constant-elements determined from at least two sets of active perforations, and computing at least one set of HF fluid pressure values and HF fluid rate absorption values, wherein the HF fluid pressure values are adjusted by a HF pump system of the well system, (2) selecting a HF fluid pressure target value from the sets of HF fluid pressure values, and (3) calculating an active fracture ratio using the HF fluid pressure target value and the constant-elements.

In another aspect, a computer program product having a series of operating instructions stored on a non-transitory computer-readable medium that directs a data processing apparatus when executed thereby to perform monitoring of active hydraulic fractures in a borehole of a well system. In one embodiment the operations include: (1) obtaining constant-elements determined from at least two sets of active perforations, and computing at least one set of HF fluid pressure values and HF fluid absorption rate values, wherein the HF fluid pressure values are adjusted by a HF pump system, (2) selecting a HF fluid pressure target value from the sets of HF fluid pressure values, and (3) calculating an active fracture ratio using the HF fluid pressure target value and the constant-elements.

In another aspect, a system to calculate a number of active fractures in a borehole of a well system undergoing hydraulic fracturing (HF). In one embodiment, the system includes: (1) a HF pump system, operable to adjust a HF fluid composition and adjust a HF fluid pressure within the borehole, (2) a HF fluid monitor system, operable to determine and transmit HF fluid pressure values and HF fluid rate absorption values, wherein the HF pump system is adjusting the HF fluid composition or the HF fluid pressure, and (3) a HF active fracture processor, operable to calculate an active fracture count using the HF fluid pressure values and the HF fluid rate absorption values from the HF fluid monitor system, wherein the active fracture count is derived from a ratio of the HF fluid rates for a selected HF fluid pressure value.

BRIEF DESCRIPTION

Reference is now made to the following descriptions taken in conjunction with the accompanying drawings, in which.

DETAILED DESCRIPTION

In the hydrocarbon production industry, i.e., oil and gas production, especially for hydraulic fracturing (HF) operations, it can be beneficial to determine more information about the surrounding formation along a portion of a borehole. Such information can include analyzing data to determine the stimulation fluid path during HF operations, which can be represented by the number of active fractures along a portion of the borehole. Active fractures are fractures that are actively absorbing or taking in the HF fluid being pumped into that portion of the borehole.

The number of active fractures can be combined with other data elements computed or determined by this or other means. The combined data set can be used by a computing system or by a well system operator to adjust a HF job operation plan for the well system, for example, to understand and design effective diversion strategies.

This disclosure presents a method and system to estimate the number of active fractures from a series of known HF fluid pressure values and corresponding known HF fluid rate absorption values. The ratio of the resulting HF fluid rate absorption values for a HF fluid pressure target value can be used to estimate an equivalent ratio of the number of active fractures. Knowing the actual functional form of the pressure loss is not needed. In alternative aspects, the HF fluid composition can be adjusted as well, adding or removing discrete elements, and the resulting change in the HF fluid rate absorption values can be determined.

Boreholes and their associated fractures can be represented as a dynamic flow path system with a limited number of active fractures (n). An active fracture can be added to or excluded from the flow path system during the HF pumping operations. Varying the HF fluid pressure via the HF pump system is one method for changing the flow path system. In addition, the HF fluid composition can be modified, such as adding or excluding proppants, other solid particulates, or chemicals. A screen-out or diverter plugging system can be used to exclude those discrete elements from the HF fluid.

Figure 1:
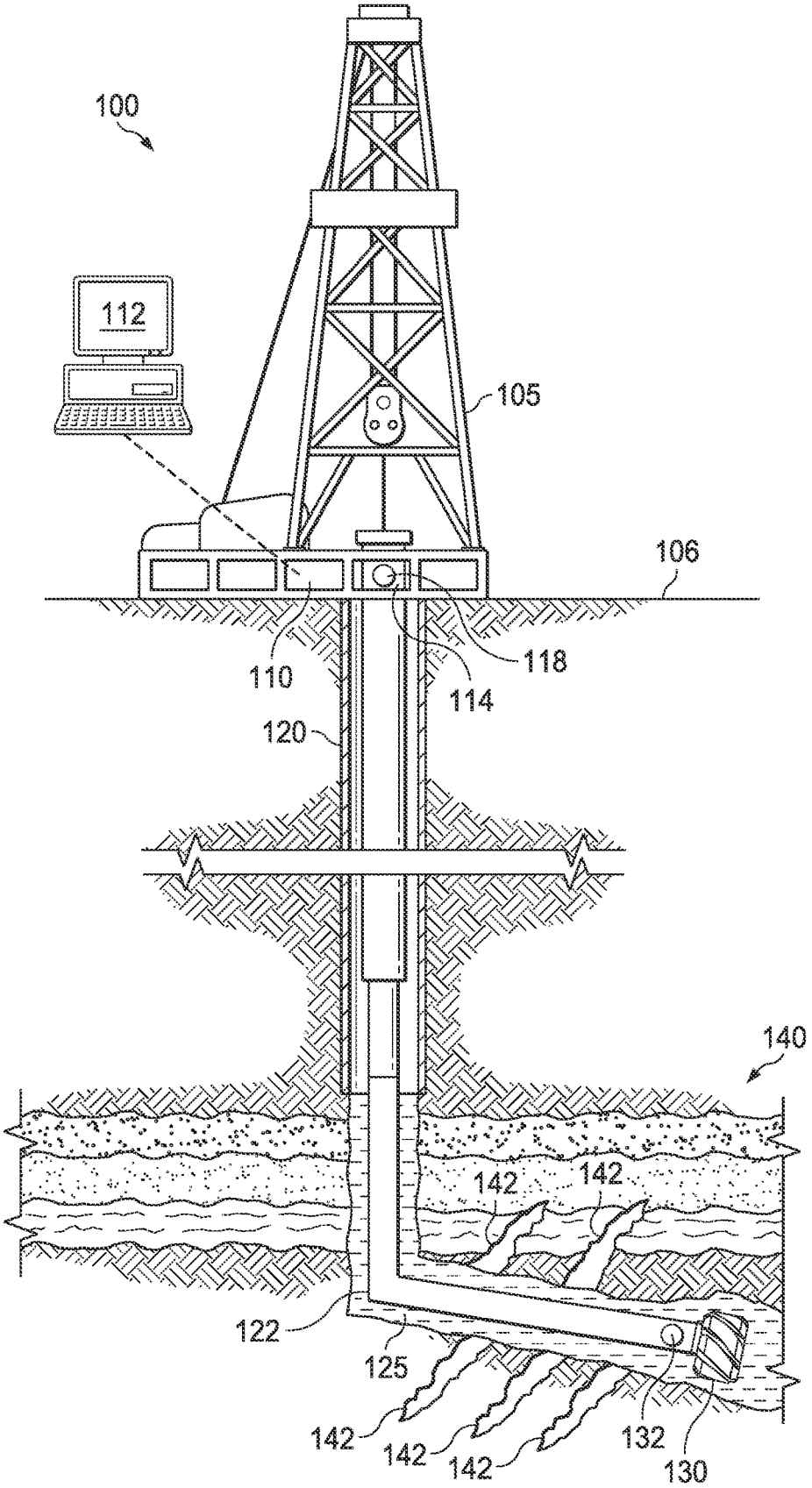
FIG. 1 is an illustration of a diagram of an example hydraulic fracturing (HF) well system.

For example, a borehole in a HF well system at a certain HF fluid pressure value can have a determined number of active fractures, e.g., fractures absorbing HF fluid (see FIG. 1). When the HF fluid pressure is increased, additional fractures can become active, increasing the number n.

A maximum number of active fractures can be determined based on the equipment inserted into the borehole, represented by N. For example, the number of perforation sections on a downhole pipe inserted into the borehole is the maximum number of active fractures that can be estimated, i.e., detected (see for example FIG. 2). In addition, as HF fluid is pumped into the borehole, active fractures may grow and connect with other fractures, or new fractures can start absorbing the HF fluid.

The number of active fractures can also depend on the HF fluid friction within the borehole and fracture environment. The different HF fluid compositions can have a different HF fluid friction coefficient, which can be used to generate a HF fluid friction parameter. The borehole can also have a friction coefficient, which can be used to generate a borehole friction parameter.

The HF fluid pressure at the location of interest along the borehole can be obtained. The HF fluid pressure can be measured by a HF fluid monitoring system. The system can include a fluid gauge included with a bottom hole assembly (BHA) inserted into the borehole or at the wellhead of the borehole. The HF fluid pressure can be computed by removing the borehole friction parameter and adding in the hydrostatic contributions from surface pressure measurements. Adjustments can also be made for the HF fluid friction parameter using model data or data collected from a fluid gauge included with the BHA.

The HF fluid pressure changes and the resulting HF fluid rate absorption values can be collected and analyzed, along with a determined set of constant-elements from the number of perforation sections. The HF fluid pressure values and the HF fluid rate absorption values can be represented by a graph plot where each additional perforation section can be plotted as a HF fluid absorption rate value against a HF fluid pressure value. As the HF fluid pressure value is changed, a new HF fluid rate absorption value can be generated for each of the then active perforation sections (see for example FIG. 3). In an alternative aspect, the HF fluid composition can be modified holding the HF fluid pressure value constant. This aspect can control for and correct HF fluid friction parameters and borehole friction parameters.

At a HF fluid pressure target value, the HF fluid rate absorption values can be analyzed. The HF fluid pressure target value can be a target value based on the type of information being sought. For example, by selecting a target value that intersects the maximum number of HF fluid rate absorption value sets, an active fracture ratio can be determined by comparing the HF fluid rate absorption values (see for example FIG. 4). Other target values can be selected, such as the target values corresponding to the start and end of an active fracture HF fluid rate absorption value set. This can produce a ratio corresponding to that particular active fracture. In other aspects, the length of each active fracture HF fluid rate absorption value set can be increased linearly to allow for a greater opportunity to identify a HF fluid pressure target value that can intersect a greater number of HF fluid rate absorption value sets.

The HF fluid rate absorption value that is at a start of a new fracture HF fluid rate absorption value set can be selected. By identifying at least two of such HF fluid rate absorption values, the ratios can be compared. This ratio represents the effectiveness of the HF pumping operations in generating additional fractures. Equation 1 demonstrates a ratio of two HF fluid rate absorption values to determine the number of active fractures.

Equation 1: HF fluid rate absorption value ratio to determine an active fracture ratio $$\frac{Q_i}{Q_j} = \frac{n_i}{n_j}$$

where Q is the HF fluid rate absorption value at a time point i and j; and n is the number of active fractures at a time point i and j.

An estimated number of fractures generated can be predicted using other constraints. For example, such constraints can include that $n_i$ and $n_j$ are greater than zero and less than N (the number of sections of perforations). The algorithm can be represented that $n_i+n_j<=N$, where $n_i$ and $n_j$ are integers.

Figure 5:
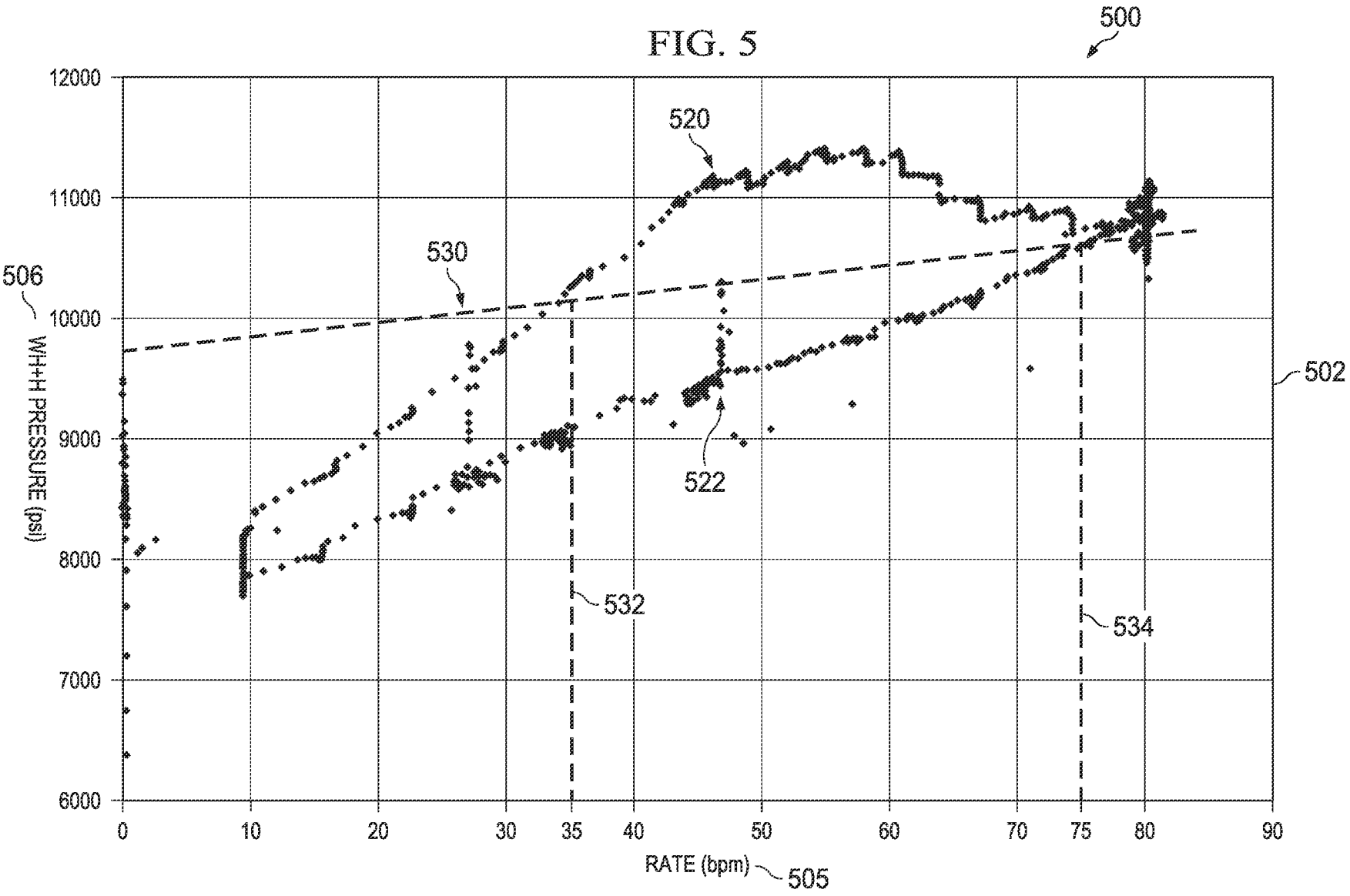
FIG. 5 is an illustration of a diagram of an example graph demonstrating a rotated HF fluid pressure target value overlaid on HF fluid rate absorption value sets.

In an alternative aspect, the HF fluid pressure target value can be a linearly dynamic, e.g., as represented in a graph—the target value can be rotated (see for example FIG. 5). This can correct for known friction parameters of the borehole or HF fluid, as long as the friction parameters are linear with respect to the HF fluid rate absorption values. The rotated HF fluid pressure target value can be used to identify appropriate ratio values to utilize in the computations.

The methods and systems of this disclosure can be utilized in real-time, near real-time, or non-real-time modes. For example, a real-time or near real-time operation can be that the number of active fractures can be determined, for a HF fluid pressure target value and HF fluid composition, by one computing system and fed into a different process or a different computing system where the information can be used to modify the HF job operation plan. In some aspects, the HF job operation can be adjusted immediately, such as by the HF pump system to modify the HF fluid composition or adjust the HF fluid pressure.

A non-real-time operation example can be that the number of active fractures, for a HF fluid pressure target value and HF fluid composition, can be provided to a well system operator or engineer where the information can be combined with other data elements and appropriate modifications to the HF job operation plan can be made and implemented at a later point in time. The system can also generate a recommendation to the well system operator or engineer based on the information. In yet other aspects, the computed number of active fractures and the data used for those computations can be transmitted to a location outside of the well system area, such as a data center or a cloud-based environment.

Turning now to the figures, FIG. 1 is an illustration of a diagram of an example HF well system 100. HF well system 100 can be a well system where additional fracturing operations are occurring, e.g., prior to or during extraction operations. HF well system 100 demonstrates a nearly horizontal borehole undergoing fracturing operations. Although FIG. 1 depicts a specific borehole configuration, those skilled in the art will understand that the disclosure is equally well suited for use in boreholes having other orientations including vertical boreholes, horizontal boreholes, slanted boreholes, multilateral boreholes, and other borehole types. FIG. 1 depicts an onshore operation. Those skilled in the art will understand that the disclosure is equally well suited for use in offshore operations.

HF well system 100 includes a surface well equipment 105 located at a surface 106, well site control equipment 110, and a HF pump system 114. In some aspects, well site control equipment 110 is communicatively connected to a separate computing system 112, for example, a separate server, data center, cloud service, tablet, laptop, smartphone, or other types of computing systems. Computing system 112 can be located proximate to the well site control equipment 110 or located a distance from the well site control equipment 110. In some aspects, HF pump system 114 can include a fluid gauge 118 located at the wellhead assembly.

Extending below the surface 106 from the surface well equipment 105 is a borehole 120. Borehole 120 can have zero or more cased sections and a bottom section that is uncased. Inserted into the borehole 120 is a fluid pipe 122. The bottom portion of the fluid pipe 122 has the capability of releasing HF fluid 125 in the fluid pipe 122 to the surrounding formations 140. The release of HF fluid 125 can be by perforations in the fluid pipe 122, by valves placed along the fluid pipe 122, or by other release means. At the end of the fluid pipe 122 is a BHA 130. In some aspects, BHA 130 can include a fluid gauge 132.

In HF well system 100, fluid pipe 122 is releasing HF fluid 125 into the formation 140. The HF fluid 125 is being absorbed by several active fractures 142. The HF fluid 125 pressure can be measured by the fluid gauge 132 of the BHA 130 or by the fluid gauge 118 of the HF pump system 114. The HF fluid pressure values determined by fluid gauge 118 or fluid gauge 132 can be communicated to well control equipment 110. In addition, the HF fluid rate absorption values, and the HF fluid composition, can be communicated to well control equipment 110 from HF pump system 114.

Well site control equipment 110 can include a HF fluid monitor system capable of receiving the HF fluid pressure values, the HF fluid rate absorption values, and the HF fluid composition. In addition, the well site control equipment 110 can include a HF active fracture processor. In other aspects, the HF fluid monitor system or the HF active fracture processor can be located with the computing system 112, in various combinations. The HF fluid monitor system can provide the received values to the HF active fracture processor to analyze the received values and to produce an estimation on the number of active fractures for a given HF fluid pressure value. In other aspects, the HF active fracture processor can receive a HF fluid pressure target value and compute an estimated active fracture ratio, e.g., the number of active fractures. In other aspects, the HF active fracture processor can also dynamically adjust the HF fluid pressure target value over the HF fluid rate absorption values utilizing received fluid and borehole friction coefficients. The adjustment can be linear or curved, depending on the friction model generating the friction coefficients.

The HF fluid monitor system can be a separate system, included with the well site control equipment 110, or the computing system 112. The HF active fracture processor can be included with the components HF fluid monitor system, the well site control equipment 110, or the computing system 112. The HF active fracture processor can be a separate computing system, be part of those components, or be a program or application executing on those components. The HF active fracture processor can be a dedicated processor, e.g., a central processing unit, a graphics processing unit, a single instruction multiple data unit, or other processor type, as well as a virtual processor or set of instructions executing on a processor or computing system.

Figure 2:
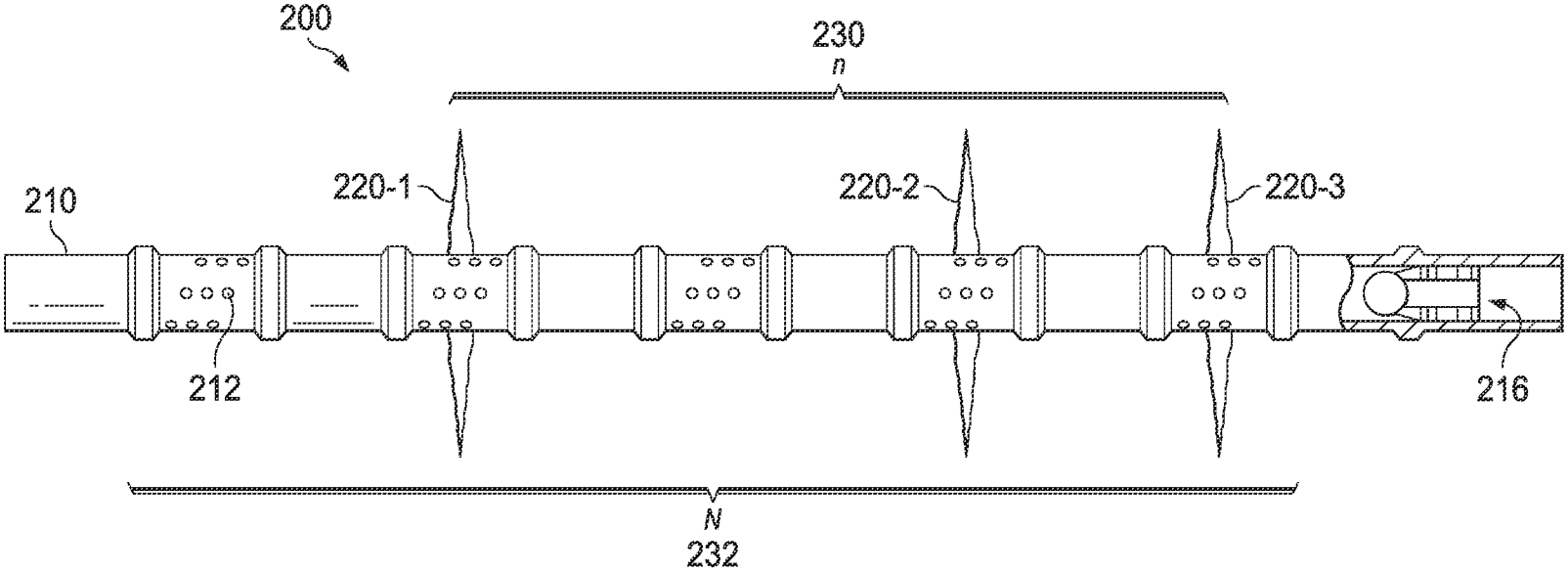
FIG. 2 is an illustration of a diagram of an example HF downhole pipe with perforations.

FIG. 2 is an illustration of a diagram of an example HF downhole pipe with perforations 200. HF downhole pipe with perforations 200 includes a downhole pipe portion 210 with perforations 212 along the length of downhole pipe portion 210. At the end of downhole pipe portion 210 is a BHA 216.

In the formation surrounding the downhole pipe portion 210 are three active fractures 220-1, 220-2, and 220-3. The number of active fractures is indicated by the variable n 230. The potential number of active fractures corresponds to the number of discrete elements, e.g., the number of sections of perforations 212, shown as variable N 232. In this demonstration, variable n 230 is equal to three and the variable N 232 is equal to five. In an implementation, the variable n 230 and the variable N 232 can vary in proportion to the length of the downhole pipe portion 210. The greater the length of downhole pipe portion 210, the greater the variable N 232, and the greater the potential of variable n 230.

Figure 3:
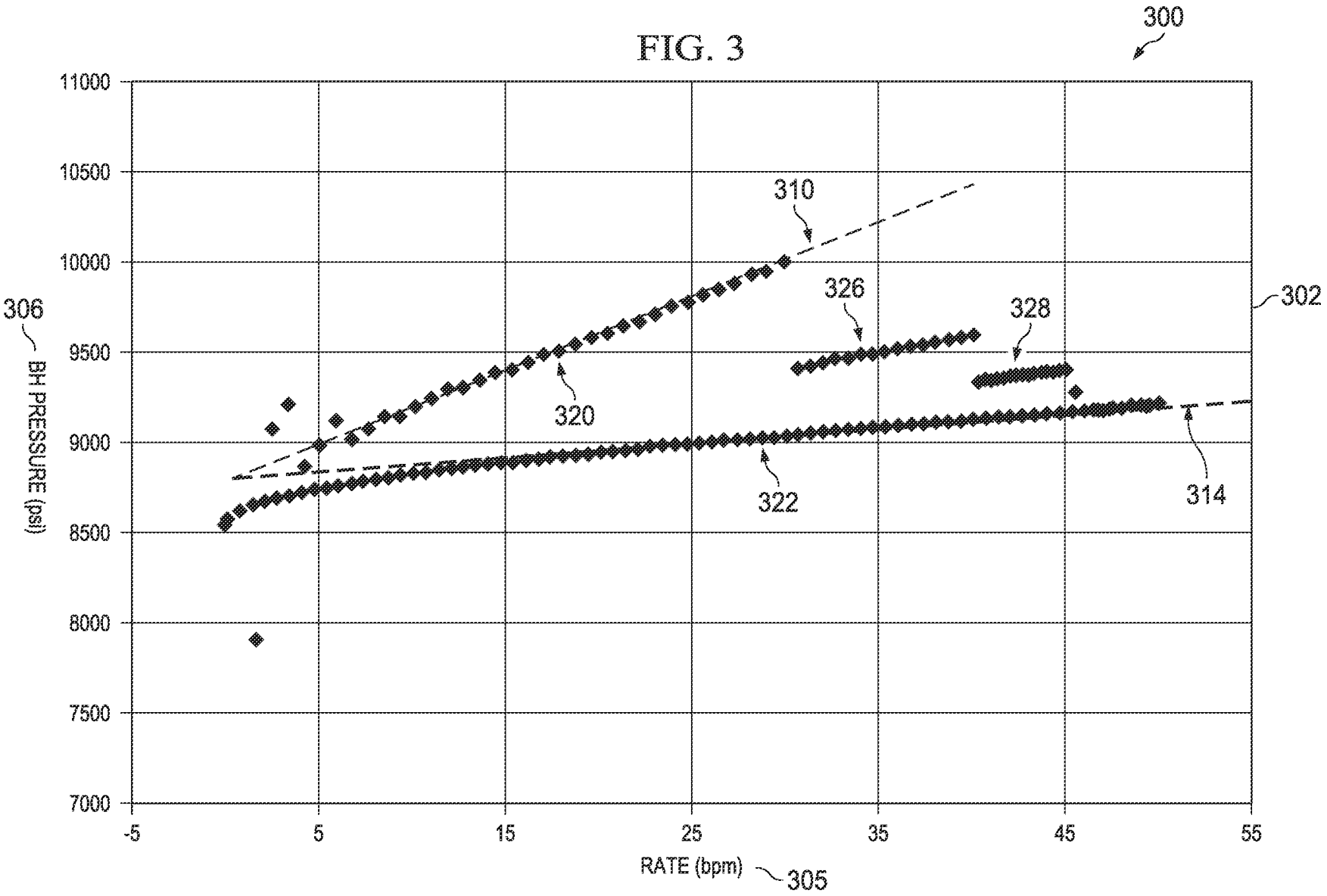
FIG. 3 is an illustration of a diagram of an example graph demonstrating HF fluid pressure values plotted with corresponding HF fluid rate absorption values.

FIG. 3 is an illustration of a diagram of an example graph 300 demonstrating HF fluid pressure values plotted with corresponding HF fluid rate absorption values. Graph 300 includes an x-axis 305 for the HF fluid rate absorption values in barrels per minute (bpm), a y-axis 306 for the HF fluid pressure values at the BHA in pounds per square inch (psi), and a chart plot 302.

Chart plot 302 has a constant-element line 310 and a constant-element line 314 determined from a known number of active perforation sections, such as n=1 for constant-element line 310 and n=5 for constant-element line 314. Chart plot 302 also has data lines 320, 322, 326, and 328 plotted on chart plot 302. Data lines 320, 322, 326, and 328 represent the HF fluid absorption rate values for different active perforation stages in the borehole. Graph 300 represents a graphical representation of the collected values. The collected values can also be represented by data manipulated by a processor, e.g., a database, data source, or other types of data storage formats. The data shown in chart plot 302 is a simulated output where the $n_i$ and $n_j$ values, from Equation 1, are known. This is demonstrating that Equation 1 holds true that the ratio of active perforation stages, e.g., active fractures, can be represented by the ratio of the injection rates.

Figure 4:
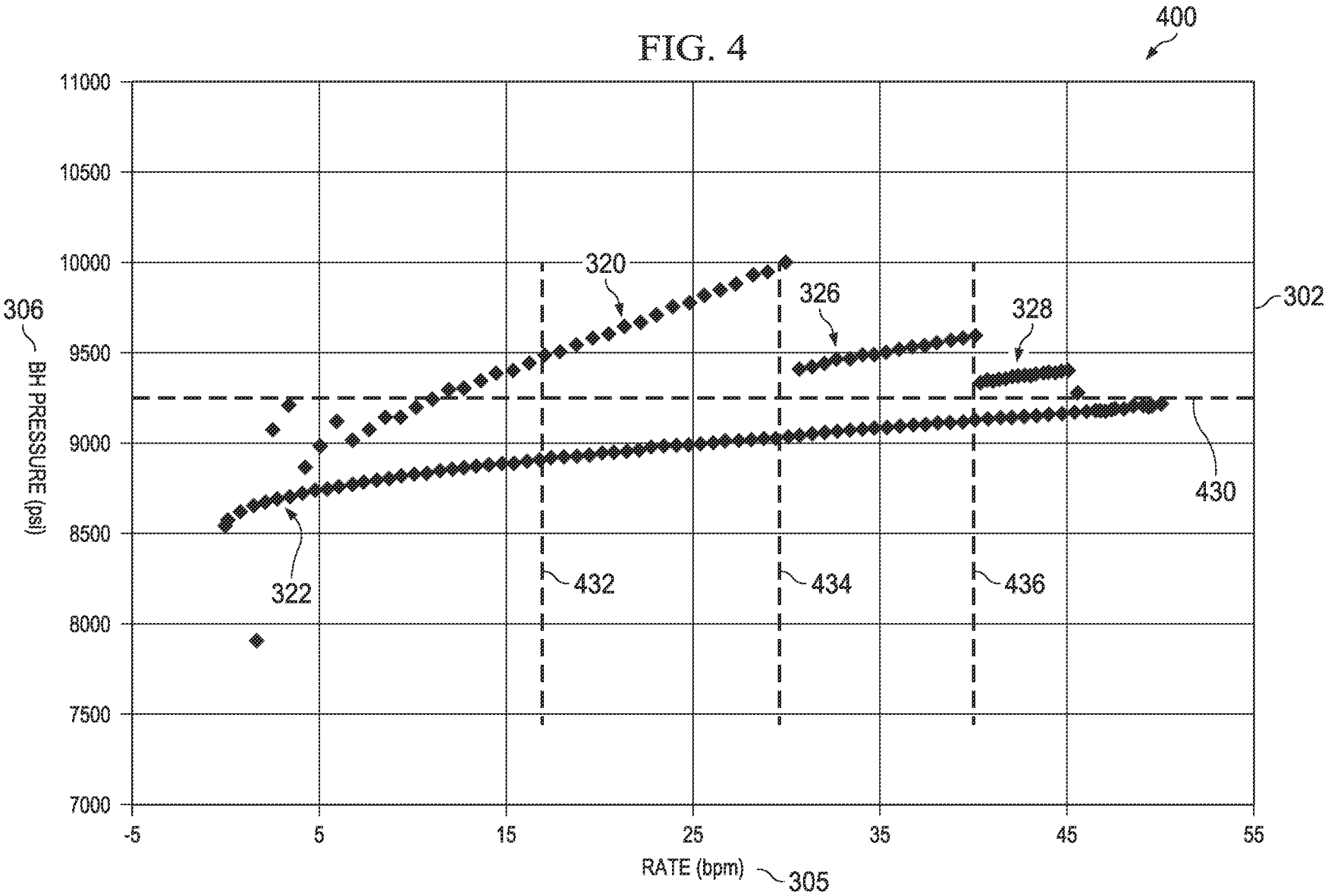
FIG. 4 is an illustration of a diagram of an example graph demonstrating a HF fluid pressure target value overlaid on the graph from FIG. 3.

FIG. 4 is an illustration of a diagram of an example graph 400 demonstrating a HF fluid pressure target value overlaid on graph 300 from FIG. 3. Graph 400 includes the x-axis 305, y-axis 306, and data lines 320, 322, 326, and 328 as described in Graph 300. Graph 400 includes an overlay of additional indicator lines including a HF fluid pressure target value 430, and three HF fluid rate absorption values 432, 434, and 436.

The HF fluid pressure target value 430 was selected for this demonstration based on a fluid pressure that maximizes the intersection points with the data lines 320, 326, and 328. In this demonstration, data line 322 does not intersect the HF fluid pressure target value 430. In other aspects, a different HF fluid pressure target value 430 can be selected depending on the information sought by the well system operator. HF fluid rate absorption value 432, approximately 15 bpm, is selected based on the intersection of the data line 320 and the HF fluid pressure target value 430. HF fluid rate absorption value 434, approximately 30 bpm is selected based on the intersection of the data line 326 and the HF fluid pressure target value 430. HF fluid rate absorption value 436, approximately 45 bpm, is selected based on the intersection of the data line 328 and the HF fluid pressure target value 430.

The active fracture ratio can be estimated from the data on graph 400 using Equation 1. Assuming $Q_i$ equals HF fluid rate absorption value 432 and $Q_j$ equals HF fluid rate absorption value 434, and $n_i$ equals one (meaning only one fracture data line intersects the HF fluid pressure target value), then $n_j$ can be estimated to be equal to two. When the HF fluid rate absorption value doubles, the number of active fractures will also double. From Equation 1:

$$\frac{Q_i}{Q_j} = \frac{n_i}{n_j} \xrightarrow{yields} \frac{15}{30} = \frac{1}{n_j} \xrightarrow{yields} n_j = 2.$$

The other ratios will also hold true:

$$\frac{15}{45} = \frac{1}{n_j} \xrightarrow{yields} n_j = 3 \text{ and } \frac{30}{45} = \frac{2}{n_j} \xrightarrow{yields} n_j = 3.$$

The functional form of the pressure drops is not needed to determine the number of active fractures. The functional form of the pressure drops is assumed to be substantially the same for all perforation elements involved in the computation and the pressure change across the perforation intervals due to stress shadowing is minimal. Equation 2 is an example conventional pressure function that includes orifice loss, tortuosity loss, and friction loss. Equation 2 demonstrates that the processes described herein can be mathematically justified.

Equation 2: Example pressure function $$P = A + B\frac{Q}{n} + C\sqrt{\frac{Q}{n}} + D\left(\frac{Q}{n}\right)^2$$

where P is the resultant pressure;

A represents formation stress on a fracture face;

B represents friction;

C represents a tortuosity loss coefficient;

D represents perforation friction loss;

Q is the HF fluid flow rate; and n is the number of active fractures.

The identification of the HF fluid pressure target value 430 is equivalent to equating Equation 2. For example, a simplified version of Equation 2 is provided in Equation 3 with the HF fluid rate absorption values and active fracture counts.

Equation 3: Simplified equated pressure functions with data values $$B\frac{Q_i}{n_i} + C\sqrt{\frac{Q_i}{n_i}} + D\left(\frac{Q_i}{n_i}\right)^2 = B\frac{Q_j}{n_j} + C\sqrt{\frac{Q_j}{n_j}} + D\left(\frac{Q_j}{n_j}\right)^2$$

this holds true when Q and n are related as shown in Equation 1.

FIG. 5 is an illustration of a diagram of an example graph 500 demonstrating a rotated HF fluid pressure target value overlaid on HF fluid rate absorption value sets. Graph 500 is similar to graph 400 with a change that the HF fluid pressure target value is rotated to account for friction within the system and the y-axis showing pressure at the wellhead. Graph 500 has an x-axis 505 for the HF fluid rate absorption values in bpm, a y-axis 506 for the wellhead pressure in psi, and a chart plot 502.

Chart plot 502 has two data lines 520 and 522 from collected data from a well system. HF fluid pressure target value 530 has been rotated to account for a borehole friction coefficient and a HF fluid friction coefficient. Two intersection points are identified. HF fluid rate line 532, at 35 bpm, is at the intersection of the HF fluid pressure target value 530 and the data line 520. HF fluid rate line 534, at 75 bpm, is at the intersection of the HF fluid pressure target value 530 and the data line 522.

Applying Equation 1, $$\frac{Q_i}{Q_j} = \frac{n_i}{n_j} \xrightarrow{yields} \frac{35}{75} = \frac{n_i}{n_j} \xrightarrow{yields} n_j = 2.14n_i.$$

This indicates an approximate doubling of the number of active fractures as the HF flow rate increases from 35 bpm to 75 bpm.

In other aspects, HP fluid pressure target value 530 can be a curve or other representative shape. The shape and rotation of the HP fluid pressure target value 530 can be computed utilizing a friction model. The friction model can be a combination of the borehole friction coefficient and the HF fluid friction coefficient.

Figure 6:
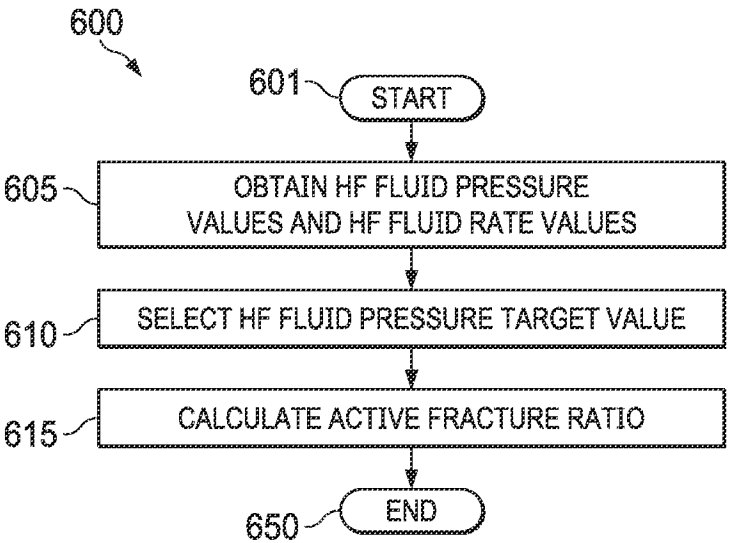
FIG. 6 is an illustration of a flow diagram of an example method demonstrating the calculation of an active fracture ratio.

FIG. 6 is an illustration of a flow diagram of an example method 600 demonstrating the calculation of an active fracture ratio. A processor, such as a HF active fracture processor as disclosed herein, can perform at least some of the steps of the method 600. Method 600 begins at a step 601 and proceeds to a step 605. At the step 605, constant-elements are determined for the wellbore environment, such as using a constant of the number of active perforation stages at n=1 and n=5. Other constant values for the number of active perforation stages can be utilized. Data points are calculated from collected HF fluid pressure values and their corresponding HF fluid rate absorption values. The constant-elements can be used in the analysis of the collected data points for the pressure/absorption rate values. At a step 610, a HF fluid pressure target value is selected. The selection can be based on maximizing the intersection between the HF fluid pressure target value and the constant-elements (as represented if plotted on a graph of HF fluid rate absorption values). In other aspects, the HF fluid pressure target value can be selected to compute other factors or to derive other information.

Proceeding to a step 615, a HF active fracture processor can compute an active fracture ratio using the constant-elements, HF fluid pressure values, and the HF fluid rate absorption values. The active fracture ratio can then be utilized to estimate the number of active fractures for a targeted HF fluid pressure value. The method 600 ends at a step 650.

Figure 7:
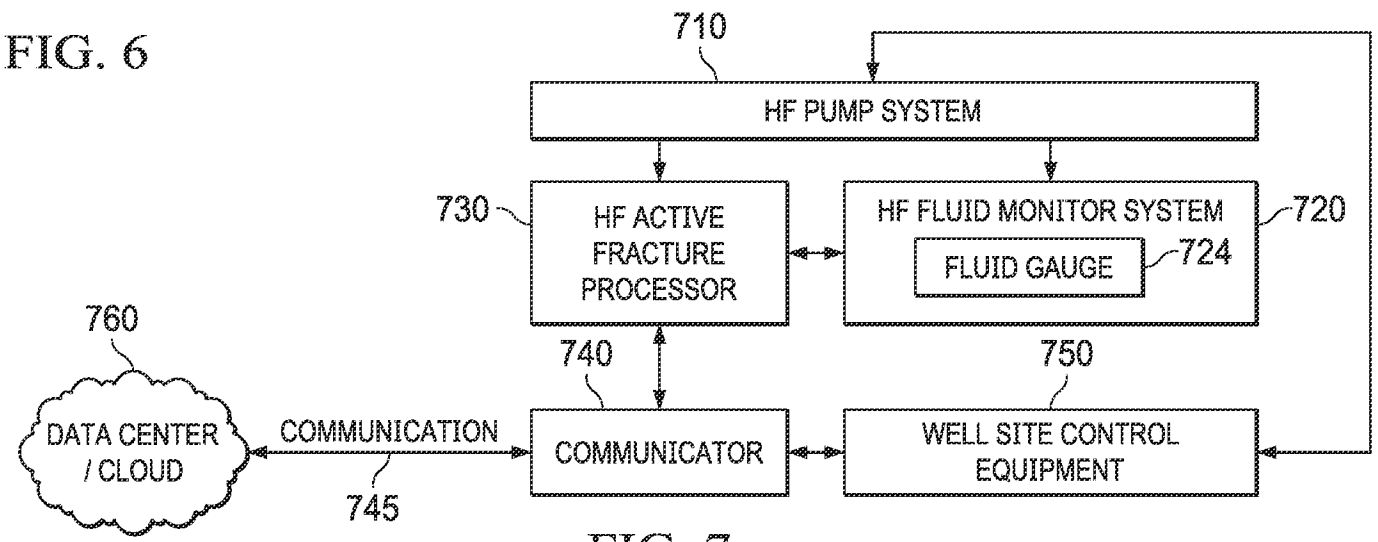
FIG. 7 is an illustration of a block diagram of an active fracture ratio computation system.

FIG. 7 is an illustration of a block diagram of an active fracture ratio computation system 700. Active fracture ratio computation system 700 includes a HF pump system 710, a HF fluid monitor system 720, and a HF active fracture processor 730. Optionally, active fracture ratio computation system 700 can include a communicator 740 and well site control equipment 750. In some aspects, a data center or cloud environment 760 can be included.

HF pump system 710 can pump HF fluid into a borehole through a fluid pipe. The HF pump system 710 can adjust the pressure at which the HF fluid is pumped through the fluid pipe. In some aspects, the HF pump system 710 can also adjust the HF fluid composition, such as modifying the amount of proppants, chemicals, or other solid particulates added or removed from the HF fluid. The HF pump system 710 can use screen-out or diverter plugging to adjust the HF fluid composition.

The HF pump system 710 is communicatively coupled to a HF fluid monitor system 720. HF fluid monitor system 720 can utilize a HF fluid gauge, such as fluid gauge 724, located at a wellhead position or a BHA position, to measure the HF fluid pressure within the borehole and to assist in monitoring the HF fluid rate of HF fluid being pumped into the subterranean formation through the fluid pipe. HF active fracture processor 730 is communicatively coupled to HF pump system 710 and to HF fluid monitor system 720. HF active fracture processor can receive the HF fluid pressure values and the HF fluid rate absorption values, and compute constant-elements and other data values. The HF active fracture processor 730 can then compute the active fracture ratio and an estimated actual fracture number, and provide this information to a well system operator or another computing system.

Communicator 740 is an optional component. If present, communicator 740 is communicatively coupled to the HF active fracture processor 730 and to a well site control equipment 750. In another aspect, communicator 740 can also be communicatively coupled, using conventional means, to another computing system 760, through communication channel 745. Communication channel 745 can be an intranet, internet, or other type of network, and can utilize Ethernet, Wi-Fi, mobile communications (e.g., 3rd Generation Partnership Project—3G, 4G, 5G), or other communication protocols. Computing system 760 can be located proximate to the well site control equipment 750 or located a distance from the well site control equipment 750. The computing system 760 can be a data center, a cloud service or environment, a server, laptop, mobile device, smartphone, or other type of computing system. In some aspects, the HF active fracture processor can be located with the computing system 760 and not be present near the well site control equipment 750.

The active fracture ratio computation system 700 can compute an active fracture ratio and estimated active fracture number and provide that information to the well site control equipment 750, to a well site operator, well engineer, or to other computing systems. The information can then be used, in conjunction with other identified data to modify the well system job operation plan. This modification can be in real-time or near real-time, such as modifying the HF pump system 710 to pump a different HF fluid composition or to pump the HF fluid at a different pressure. The modification to the well system job operation plan can be used to develop future well system job operation plans and to modify the current well system job operation plan at a later point in time.

A portion of the above-described apparatus, systems or methods may be embodied in or performed by various digital data processors or computers, wherein the computers are programmed or store executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

It is noted that as used herein and in the appended claims, the singular forms "a", "an", and "the" include plural referents unless the context clearly dictates otherwise.

Aspects Disclosed Herein Include:

A. A method for estimating a number of active fractures in a borehole of a well system during a hydraulic fracturing (HF) operation, including: (1) obtaining constant-elements determined from at least two sets of active perforations, and computing at least one set of HF fluid pressure values and HF fluid rate absorption values, wherein the HF fluid pressure values are adjusted by a HF pump system of the well system, (2) selecting a HF fluid pressure target value from the sets of HF fluid pressure values, and (3) calculating an active fracture ratio using the HF fluid pressure target value and the constant-elements.

B. A computer program product having a series of operating instructions stored on a non-transitory computer-readable medium that directs a data processing apparatus when executed thereby to perform monitoring of active hydraulic fractures in a borehole of a well system, the operations including: (1) obtaining constant-elements determined from at least two sets of active perforations, and computing at least one set of HF fluid pressure values and HF fluid absorption rate values, wherein the HF fluid pressure values are adjusted by a HF pump system, (2) selecting a HF fluid pressure target value from the sets of HF fluid pressure values, and (3) calculating an active fracture ratio using the HF fluid pressure target value and the constant-elements.

C. A system to calculate a number of active fractures in a borehole of a well system undergoing hydraulic fracturing (HF), wherein the system includes: (1) a HF pump system, operable to adjust a HF fluid composition and adjust a HF fluid pressure within the borehole, (2) a HF fluid monitor system, operable to determine and transmit HF fluid pressure values and HF fluid rate absorption values, wherein the HF pump system is adjusting the HF fluid composition or the HF fluid pressure, and (3) a HF active fracture processor, operable to calculate an active fracture count using the HF fluid pressure values and the HF fluid rate absorption values from the HF fluid monitor system, wherein the active fracture count is derived from a ratio of the HF fluid rates for a selected HF fluid pressure value.

Each of aspects A, B, and C can have one or more of the following additional elements in combination: Element 1: wherein the HF fluid pressure values are measured using a fluid gauge included with a bottom hole assembly. Element 2: wherein the HF fluid pressure values are measured using a fluid gauge included with a wellhead assembly. Element 3: further comprising transmitting the active fracture ratio to a well system operator. Element 4: further comprising transmitting the active fracture ratio to another computing system. Element 5: further comprising modifying a HF job operation plan using the active fracture ratio. Element 6: wherein the HF pump system further comprises modifying a HF fluid composition used by the HF pump system using a combination of HF fluids, proppants, chemicals, and particulates. Element 7: wherein the HF pump system further comprises adjusting the HF fluid composition by excluding select chemicals and particulates using a screen-out or diverter plugging system. Element 8: wherein the selecting the HF fluid pressure target value further comprises varying the HF fluid pressure target value as the HF fluid rate absorption value increases, wherein a borehole friction parameter is linear with respect to the HF fluid rate absorption values. Element 9: wherein the HF fluid monitor comprises a fluid gauge operable to determine a HF fluid pressure. Element 10: wherein the fluid gauge is included with a wellhead of the well system. Element 11: wherein the fluid gauge is included with a bottom hole assembly, wherein the bottom hole assembly is inserted into the borehole. Element 12: wherein the fluid gauge is further operable to determine a HF fluid friction parameter. Element 13: wherein the HF pump system is further operable to modify the HF fluid composition by adding discrete elements to the HF fluid or excluding discrete elements from the HF fluid, wherein the discrete elements are one or more of proppants, chemicals, or particulates. Element 14: wherein the HF active fracture processor is further operable to dynamically adjust the selected HF fluid pressure value utilizing a HF fluid friction parameter, wherein the HF fluid friction parameter changes linearly with a change in the HF fluid pressure. Element 15: further comprising a communicator, operable to communicate HF data, wherein the HF data includes at least one of the ratio, the active fracture count, the HF fluid pressure values, and the HF fluid rate absorption values to at least one other computing system. Element 16: further comprising a well site control equipment, operable to receive the HF data from the communicator and to modify a HF job operation plan.

What is claimed is:

1. A method for estimating a number of active fractures in a borehole of a well system during a hydraulic fracturing (HF) operation, comprising:

obtaining at least two constant-element lines where each constant-element line corresponds to a known number of active perforations, and computing at least one set of HF fluid pressure values and HF fluid absorption rate values, wherein the HF fluid pressure values are adjusted by a HF pump system of the well system;

selecting a HF fluid pressure target value from the at least one set of HF fluid pressure values and HF fluid absorption rate values; and calculating an active fracture ratio using the HF fluid pressure target value and the constant-element lines.

2. The method as recited in claim 1, wherein the HF fluid pressure values are measured using a fluid gauge included with a bottom hole assembly.

3. The method as recited in claim 1, wherein the HF fluid pressure values are measured using a fluid gauge included with a wellhead assembly.

4. The method as recited in claim 1, further comprising:

transmitting the active fracture ratio to a well system operator; and modifying a HF job operation plan using the active fracture ratio.

5. The method as recited in claim 1, further comprising:

modifying a HF fluid composition used by the HF pump system using a combination of HF fluids, proppants, chemicals, and particulates.

6. The method as recited in claim 5, further comprising:

adjusting the HF fluid composition by excluding select chemicals and particulates using a screen-out or diverter plugging system.

7. The method as recited in claim 1, wherein the selecting the HF fluid pressure target value further comprises:

varying the HF fluid pressure target value as the HF fluid absorption rate value increases, wherein a borehole friction parameter is linear with respect to the HF fluid absorption rate values.

8. A computer program product having a series of operating instructions stored on a non-transitory computer-readable medium that directs a data processing apparatus when executed thereby to perform monitoring of active hydraulic fractures in a borehole of a well system, the operations comprising:

obtaining at least two constant-element lines where each constant-element line corresponds to a known number of active perforations, and computing at least one set of HF fluid pressure values and HF fluid absorption rate values, wherein the HF fluid pressure values are adjusted by a HF pump system of the well system;

selecting a HF fluid pressure target value from the at least one set of HF fluid pressure values and HF fluid absorption rate values; and calculating an active fracture ratio using the HF fluid pressure target value and the constant-element lines.

9. The computer program product as recited in claim 8, wherein the HF fluid pressure values are measured using a fluid gauge included with a bottom hole assembly.

10. The computer program product as recited in claim 8, wherein the HF fluid pressure values are measured using a fluid gauge included with a wellhead assembly.

11. The computer program product as recited in claim 8, wherein the operations further comprise:

transmitting the active fracture ratio to another computing system; and modifying a HF job operation plan using the active fracture ratio.

12. The computer program product as recited in claim 8, wherein the operations further comprise:

modifying a HF fluid composition used by the HF pump system using a combination of HF fluids, proppants, chemicals, and particulates.

13. The computer program product as recited in claim 12, wherein the operations further comprise:

adjusting the HF fluid composition by excluding select chemicals and particulates using a screen-out or diverter plugging system.

14. The computer program product as recited in claim 8, wherein the operations for the selecting the HF fluid pressure target value further comprise:

varying the HF fluid pressure target value as the HF fluid absorption rate value increases, wherein a borehole friction parameter is linear with respect to the HF fluid absorption rate values.

15. A system to calculate a number of active fractures in a borehole of a well system undergoing hydraulic fracturing (HF), wherein the system comprises:

a HF pump system, operable to adjust a HF fluid composition and adjust a HF fluid pressure within the borehole;

a HF fluid monitor system, operable to determine and transmit HF fluid pressure values and HF fluid absorption rate values, wherein the HF pump system is adjusting the HF fluid composition or the HF fluid pressure values; and a HF active fracture processor, operable to calculate an active fracture count using the HF fluid pressure values and the HF fluid absorption rate values from the HF fluid monitor system, wherein the active fracture count is derived from a ratio of the HF fluid absorption rate values for a selected HF fluid pressure value.

16. The system as recited in claim 15, wherein the HF fluid monitor comprises a fluid gauge operable to determine a HF fluid pressure.

17. The system as recited in claim 16, wherein the fluid gauge is included with a wellhead of the well system.

18. The system as recited in claim 16, wherein the fluid gauge is included with a bottom hole assembly, wherein the bottom hole assembly is inserted into the borehole.

19. The system as recited in claim 16, wherein the fluid gauge is further operable to determine a HF fluid friction parameter.

20. The system as recited in claim 15, wherein the HF pump system is further operable to modify the HF fluid composition by adding discrete elements to the HF fluid or excluding discrete elements from the HF fluid, wherein the discrete elements are one or more of proppants, chemicals, or particulates.

21. The system as recited in claim 15, wherein the HF active fracture processor is further operable to dynamically adjust the selected HF fluid pressure value utilizing a HF fluid friction parameter, wherein the HF fluid friction parameter changes linearly with a change in the HF fluid pressure.

22. The system as recited in claim 15, further comprising:

a communicator, operable to communicate HF data, wherein the HF data includes at least one of the ratio, the active fracture count, the HF fluid pressure values, and the HF fluid absorption rate values to at least one other computing system; and well site control equipment, operable to receive the HF data from the communicator and to modify a HF job operation plan.

* * * * *